US010780007B1

(12) United States Patent
Seitz

(10) Patent No.: US 10,780,007 B1
(45) Date of Patent: Sep. 22, 2020

(54) FABRIC URN

(71) Applicant: Julia A. Seitz, Federal Way, WA (US)

(72) Inventor: Julia A. Seitz, Federal Way, WA (US)

( * ) Notice: Subject to any disclaimer, the term of this patent is extended or adjusted under 35 U.S.C. 154(b) by 0 days.

(21) Appl. No.: 16/255,773

(22) Filed: Jan. 23, 2019

Related U.S. Application Data

(60) Provisional application No. 62/620,992, filed on Jan. 23, 2018.

(51) Int. Cl.
*A61G 17/08* (2006.01)

(52) U.S. Cl.
CPC ..... *A61G 17/08* (2013.01)

(58) Field of Classification Search
CPC ..... A61G 17/08; A63H 3/02; A63H 3/005
USPC ..... 27/1; 446/73, 369
See application file for complete search history.

(56) References Cited

U.S. PATENT DOCUMENTS

D401,347 S * 11/1998 Cosentino ..... D24/208
5,944,577 A * 8/1999 Yanofsky ..... A63H 3/005 281/29
6,755,712 B2 * 6/2004 Morris ..... A63H 3/005 446/268
6,785,938 B1 * 9/2004 Johansen, Jr. ..... A61G 17/08 27/1
7,308,741 B1 * 12/2007 Rydberg ..... A61G 17/08 27/1
7,526,844 B2 * 5/2009 Pearce ..... A61G 17/08 27/1
7,627,935 B1 * 12/2009 Ostrum ..... A61G 17/08 27/1
D629,584 S * 12/2010 Riehl ..... D99/5
8,152,587 B1 * 4/2012 Brown ..... A63H 3/02 206/216
9,925,470 B1 * 3/2018 Palacio ..... A63H 3/005
9,988,196 B2 * 6/2018 Glass ..... B65D 73/0078
D844,929 S * 4/2019 Williams, Jr. ..... D99/3
10,272,348 B2 * 4/2019 Brant ..... A63H 3/005
D851,853 S * 6/2019 Khan ..... D99/5
2002/0100152 A1 * 8/2002 Ortega ..... A61G 17/08 27/1
2002/0168919 A1 * 11/2002 Perkins ..... A63H 3/005 446/369
2006/0059669 A1 * 3/2006 Rose ..... A61G 17/08 27/1

(Continued)

*Primary Examiner* — William L Miller

(57) ABSTRACT

A remembrance holder, and in particular, a fabric urn that can be comfortably held, hugged, and carried, while safely and securely suspending the beloved's cremains, whether human or animal, and/or mementos to prevent movement and spillage. The fabric urn comprises a cover, at least two support layers, a keepsake pouch, and a divider affixed to an interior surface of the keepsake pouch. The two support layers are placed within the cover. The cremains and/or mementos are placed inside the keepsake pouch as desired and the keepsake pouch is placed between the two support layers within the cover. Placement of the keepsake pouch between the support layers and the divider prevents the keepsake pouch, as well as its contents, from moving around inside the fabric urn. Based on the fabric material of the cover and the support layers, the fabric urn is soft and fluffy, similar to a pillow, and can be held or viewed as a soft-natured display for comfort and memory keeping.

19 Claims, 7 Drawing Sheets

(56) References Cited

U.S. PATENT DOCUMENTS

| | | | | |
|---|---|---|---|---|
| 2007/0232186 | A1* | 10/2007 | Shamah | A63H 3/005<br>446/369 |
| 2008/0032594 | A1* | 2/2008 | Magener | A63H 3/005<br>446/369 |
| 2013/0152348 | A1* | 6/2013 | Taylor | A61G 17/08<br>27/1 |
| 2014/0227933 | A1* | 8/2014 | Bagla | A63H 3/02<br>446/73 |
| 2019/0070056 | A1* | 3/2019 | Seltzer | A63H 3/02 |

* cited by examiner

FABRIC URN

CROSS-REFERENCE TO RELATED APPLICATIONS

U.S. Provisional Patent Application No. 62/620,992 by Julia A. Seitz, First Named Inventor/Applicant. USPTO Electronic Acknowledgement Receipt Confirmation Number 5999 on Jan. 23, 2018.

FIELD

The invention relates in general to remembrance holders, and in particular, to a fabric urn.

BACKGROUND OF THE INVENTION

When a loved one passes, many options exist for holding the remains of the beloved, whether human or animal, including housings, such as caskets, urns, and boxes, as well as other types and shapes of vessels. "Remains" by a broad definition can include the loved one's body after passing and any personal belongings, including mementos. The cremated remains of a body, with or without any of their belongings, is formally referred to as "cremains," or informally can be called ashes. "Cremation" is the transformational process by which cremated remains are created and is more common now as part of the after care of a beloved's body, for one because it's more common for people to be mobile and wish their beloveds' remains to be with them or nearby to cherish and tend to them.

Generally, remains and cremains' housings are made from a hard material, such as porcelain, glass, marble, bronze, or biodegradable material, such as recycled paper, clay, plant fibers, and wood, and are stored in a mausoleum or columbarium for example, or displayed in the home of a surviving individual. Unfortunately, not all survivors grieving the death of a loved one may find comfort in viewing a hard container for housing the beloved's remains. A hard container may, by some, be perceived as sterile in nature. Individuals who are grieving may wish to embrace and hold their beloved again and a hard container is not necessarily designed for these types of comforting, sensory experiences.

Currently, there exist other types of remains' housings, other than the standard housings as described above, such as replicas, teddy bears, and books. However, when placed within the alternative remains' housings, the remains are not generally suspended and can move around, which can be unsettling to an individual. Additionally, the more the remains move around, the higher the chance that some of the remains may spill.

Accordingly, there exists a need for a fabric urn that can be comfortably held, hugged, and carried, while suspending the beloved's cremains and/or mementos to prevent movement and spillage. Preferably, such fabric urn provides the secure containment of the remains within the urn, such that the remains do not move around freely.

BRIEF SUMMARY OF THE INVENTION

The fabric urn includes a cover, at least two support layers, and a keepsake pouch. The cover can be made from fabric, including cotton, silk, linen, wool, hemp, velvet, rayon, and polyester, as well as other types of fabric. The two support layers are placed within the cover and the keepsake pouch is placed between the two support layers within the cover. The support layers each include padding, such as synthetic fiber fill, cotton, or wool. Prior to placing the keepsake pouch in the cover, the cremains of a loved one and/or mementos, such as photographs, letters, and clips of hair, can be placed within the keepsake pouch. Placement of the keepsake pouch between the support layers prevents the keepsake pouch, as well as the contents in the keepsake pouch, from moving around inside the fabric urn. Further, based on the fabric material of the cover and the support layers, the fabric urn is soft and fluffy, similar to a pillow, and can be easily held, hugged, or carried by an individual. Additionally, the fabric urn provides an attractive, soft-natured display for holding the cremains and/or mementos.

Still other embodiments will become readily apparent to those skilled in the art from the following detailed description, wherein are described embodiments by way of illustrating the best mode contemplated. As will be realized, other and different embodiments are possible and their several details are capable of modifications in various obvious respects, all without departing from the spirit and the scope. Accordingly, the drawings and detailed description are to be regarded as illustrative in nature and not as restrictive.

DETAILED DESCRIPTION OF THE INVENTION

Handling the care of a loved one's body and belongings after their passing, while grieving their earthly loss, is a significant and difficult time in a surviving individual's life. If decisions haven't been made previously, the surviving individual will likely need to find appropriate remains' housings and decide, from an array of options, the best selection for their beloved. The remains of a loved one can be placed in a casket and buried or the remains can be placed directly into a mausoleum. Remains can alternatively be cremated and placed in a container for storing at a cemetery in a columbarium for example, or within the surviving individual's home. The container can be an urn, box, or other vessel for holding the cremains.

Currently, most holding containers are made from a hard material, such as porcelain, glass, marble, bronze, or biodegradable material, such as recycled paper, clay, plant fibers, and wood, and stored or displayed. However, when the cremains reside with the individual, a hard container used merely for display may not provide comfort to the individual. Thus, a soft urn, which houses the remains of the loved one, that can be held, hugged, and carried, can provide a feeling of comfort and security to the surviving individual who misses and grieves their beloved's physical closeness.

Figure 1:
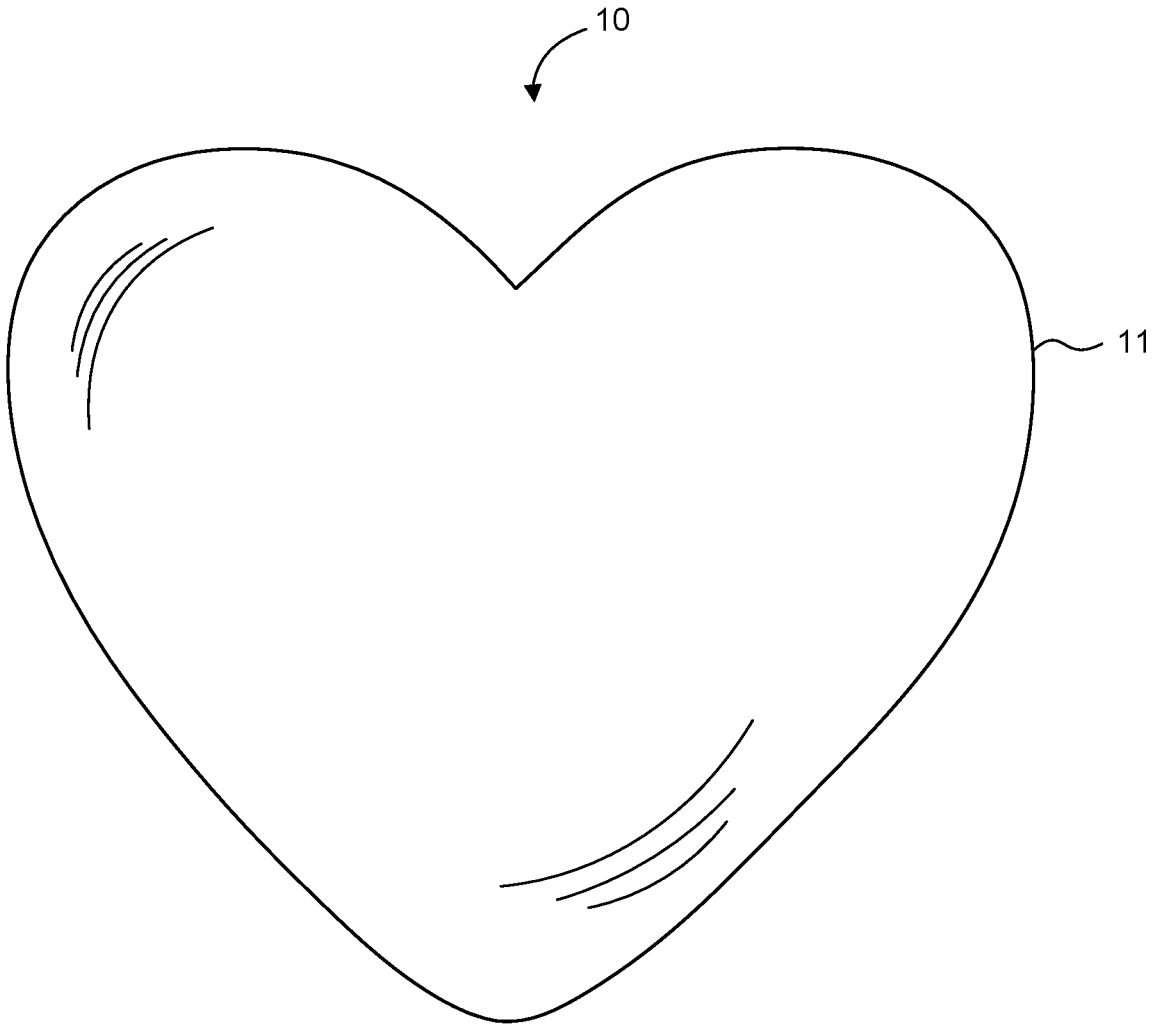
FIG. 1 is a front view showing a fabric urn, in accordance with one embodiment.

A fabric urn can be weighted with the remains of the beloved, which can provide a sense of comfort and security, when held, hugged, or carried by the surviving individual. FIG. 1 is a front view showing a fabric urn 10, in accordance with one embodiment. The fabric urn 10 can include a cover 11, at least two support layers (not shown), keepsake pouch (not shown), and keepsake pouch bottom insert (not shown). The support layers, keepsake pouch, and keepsake pouch bottom insert are described in further detail below with respect to FIG. 2. The fabric urn 10 can be constructed as any shape, including a circle, oval, square, arch, animal, or other object. As an example, the fabric urn shown in the figures and discussed below, will be described as having a heart shape, although other shapes are possible. The cover 11 can be made from fabric, such as cotton, silk, linen, wool, hemp, velvet, rayon, and polyester, as well as other types of fabrics made of natural and man-made fibers. Further, in another embodiment, other types of material can be used, such as fleece, leather, and suede. The fabrics can be patterned, solid, or embroidered. Further characteristics of the fabrics are possible.

The cover 11 includes two pieces of fabric or other material, which can be the same or different, in a particular shape, such as a heart. The two material pieces are affixed to one another, along an outer edge of the cover shape, via glue, thread, hook and loop fasteners, snaps, or other adhesive material. Affixing the pieces along the outer edge allow a void on the inside of the cover in which the support layers and keepsake pouch can be placed. In one embodiment, the two material pieces are sewed together. Along one side of the cover, where the two material pieces meet, close to the pointed end of the heart, an opening can be formed. For other shapes of fabric urns, the opening can be placed in a location on the shape that is easy to access for placing and removing the support layers and keepsake pouch, which can be dependent on the shape. The opening allows insertion of the support layers and keepsake pouch and can be opened and closed via adhesive material such as hook and loop fasteners, snaps, buttons, or a zipper.

The size of the cover 11 and the fabric urn 10 should be reasonable, such that the urn can be held and carried by the individual. In one embodiment, the cover can have a width of around 17.5 inches across the heart and a height of around 14 inches. Additionally, the opening can be around 11 inches and can start at around 2 inches from the bottom point of the heart shape. However, other sizes are possible.

Figure 2:
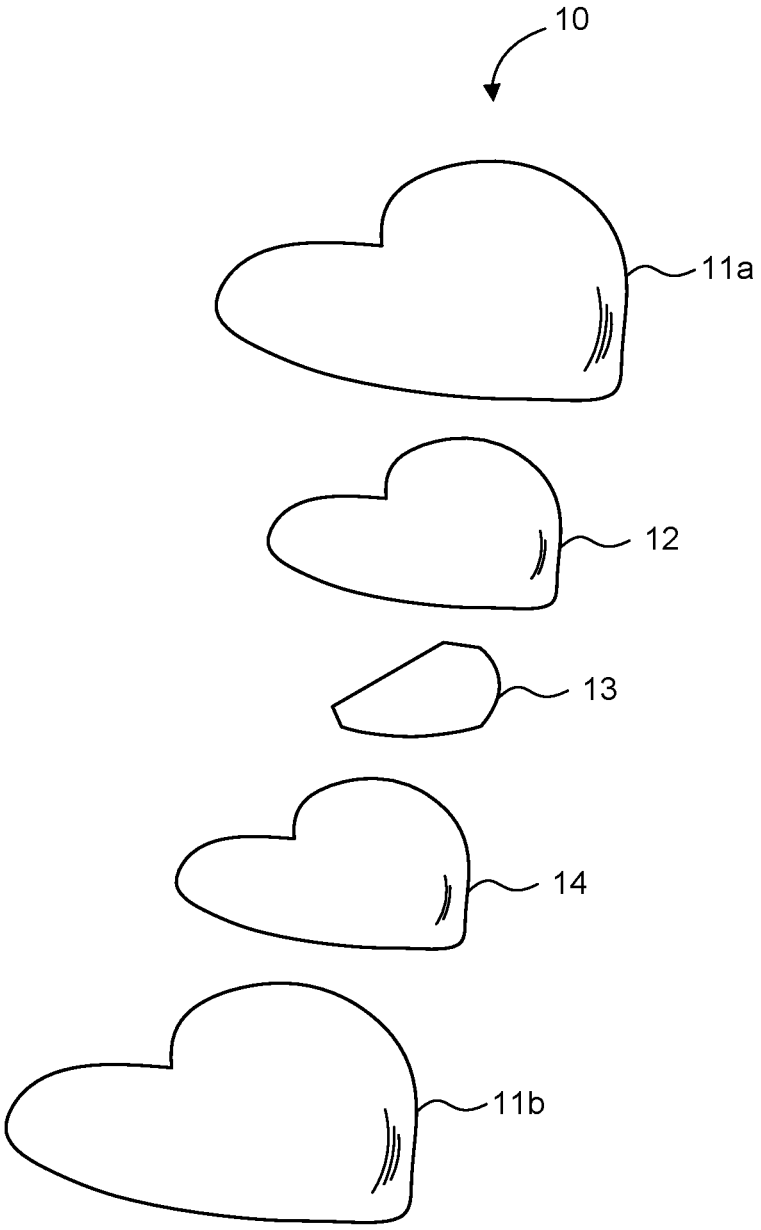
FIG. 2 is an exploded view showing the fabric urn of FIG. 1.

As described above, the fabric urn 10 can include multiple components. FIG. 2 is an exploded view showing the fabric urn of FIG. 1. The fabric urn 10 includes a cover 11 having a front cover 11*a* and a back cover 11*b* that are attached along the outer edges of the cover, as described above with respect to the FIG. 1. When inserted in the cover 11, a first support layer 12 can be provided adjacent to an inside surface of the front cover 11*a* and a second support layer 14 can be provided adjacent to an inside surface of the back cover 11*b*.

Each of the support layers 12, 14 can include two pieces of material having a common shape, which can be the same or different than the cover 11. The material can include fabrics, such as cotton, silk, linen, wool, hemp, velvet, rayon, and polyester, as well as other types of material. A size of the support layers 12, 14 can be dependent on the shape and size of the cover 11. For example, the larger the cover, the larger the support layers should be constructed. At a minimum, the support layers 12, 14 should be small enough to easily fit within the opening of the cover 11, while large enough to fill the cover 11 by touching the outer edges on the inside of the cover 11.

The material pieces of the support layers 12, 14 can be affixed along at least a portion of an outer edge via glue, thread, hook and loop fasteners, snaps, or other adhesive material. In one embodiment the material pieces of the support layers 12, 14 are sewn together along the other edges. An opening can be formed along a portion of the outer edge of each support layer 12, 14 to allow placement and removal of stuffing, such as synthetic fiber fill, cotton, or wool. The size of the opening can be dependent on the size of the support layers, which can be dependent on the size of the cover. In one example, the opening can be 7 inches; however, other sizes are possible. In the same example, the opening can begin 4 inches from the bottom of the shape. A softness or fluffiness of the fabric urn 10 is dependent on an amount of stuffing provided in the support layers 12, 14. The opening of the support layers 12, 14 can be formed in the same location or a different location than the opening of the cover 11.

Figure 3:
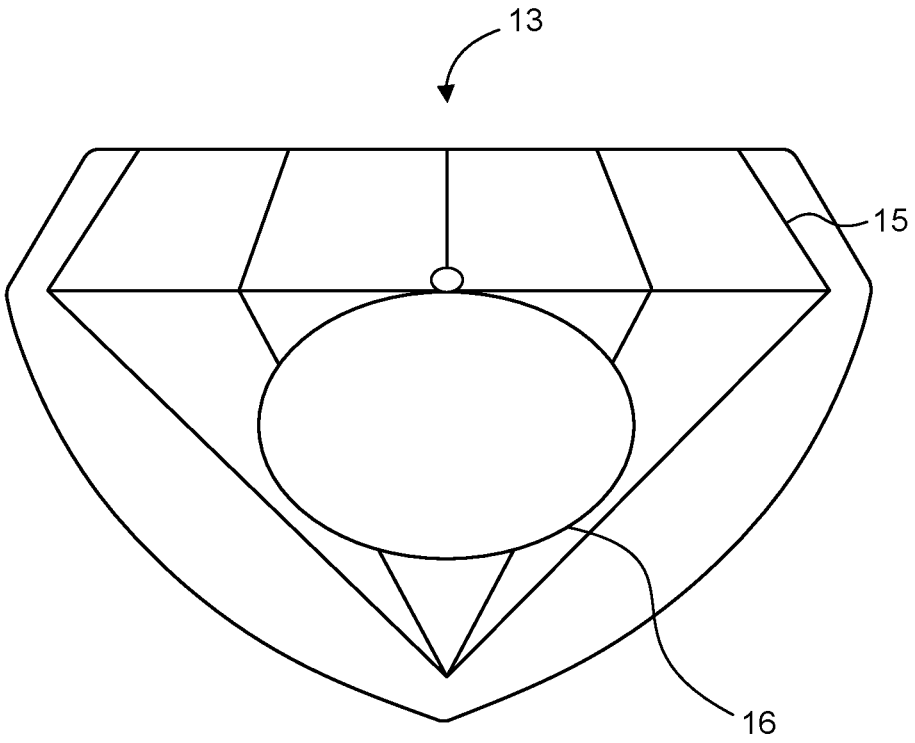
FIG. 3 is a front view showing, by way of example, a keepsake pouch.

A keepsake pouch 13 can be placed between the support layers 12, 14 and aligned with a bottom of the cover 11 and support layers 12, 14. In the current example, the keepsake pouch 13 is placed near the pointed end of the heart shape cover and support layers, and centered around the middle of the heart or above the middle. The keepsake pouch 13 can be constructed as a pouch for holding remains, including cremains and/or mementos of a loved one. FIG. 3 is a front view showing, by way of example, a keepsake pouch 13. The keepsake pouch 13 includes two pieces of material that can be sewn together along the outer edges of the fabric on the left and right sides and the bottom end, leaving an opening along the top. The opening can be opened and closed via a secure fastener, such as a zipper, buttons, snaps, and hook and loop fasteners, as well as other fasteners, to allow an individual to place the cremains and/or the mementos of a loved one inside the keepsake pouch 13, for placement within the cover 11.

The shape of the keepsake pouch 13 can be dependent on the shape of the fabric urn 10. For example, if the fabric urn has a square shape, the keepsake pouch 13 can also have a square shape or a rectangular shape. With respect to a heart shape fabric urn 10, the keepsake pouch 13 can have a shape that closely resembles an upside down arch or can also resemble a bottom portion of the heart. Specifically, the top of the keepsake pouch 13 is straight, while the sides can be rounded beginning from the top and ending in a point near the bottom. At a minimum, the shape of the keepsake pouch 13 should help prevent movement of the keepsake pouch 13 within the cover 11. In one example, the keepsake pouch 13 can be around 15 inches at the widest point, around 13 inches along a top of the keepsake pouch 13 at the opening, and around 9.5 inches in height.

The material for the keepsake pouch 13 can include fabric, such as cotton, silk, linen, wool, hemp, velvet, rayon, and polyester, as well as other material, such as fleece, leather, and suede. Other types of fabrics and materials are possible for constructing the keepsake pouch 13. Also, the material can have different colors, patterns, textures, designs, drawings, and stitching designs 15.

In one embodiment, a display frame 16 can be provided on the front of the keepsake pouch 13. The display frame 16 can include a piece of transparent or clear fabric or material, such as plastic, that is sewn or otherwise adhered to the front of the keepsake pouch 13 to form a slot or pocket. The display frame 16 can have a square, circle, oval, rectangular, or other type of shape. An ID card, certificate of cremation (required by TSA for airline travel-must accompany cremains on outside of container), photograph, or memento can be placed into the display frame for identifying a human or animal's remains inside the keepsake pouch 13 or as a visible remembrance keeper. In a further embodiment, the display frame 16 can be made of an opaque fabric or material and serve as a covered display that can be secured when closed by a button, clip, snap, or other fastener.

Figure 4A:
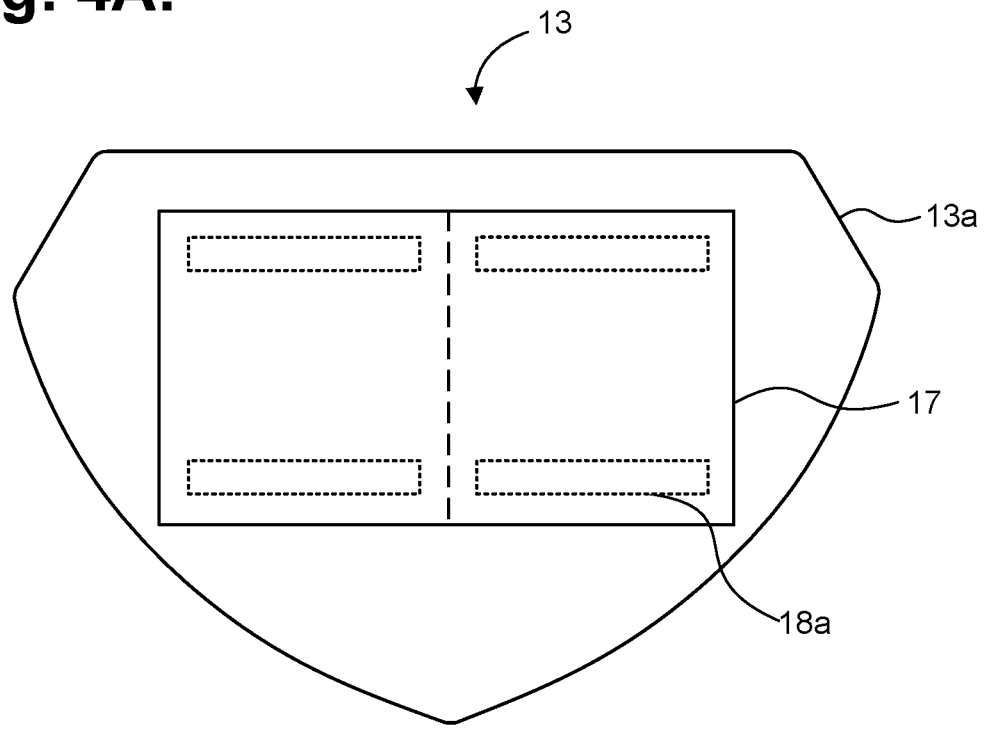
FIG. 4A is a view of an inside surface of the keepsake pouch of FIG. 3 with a divider.
Figure 4B:
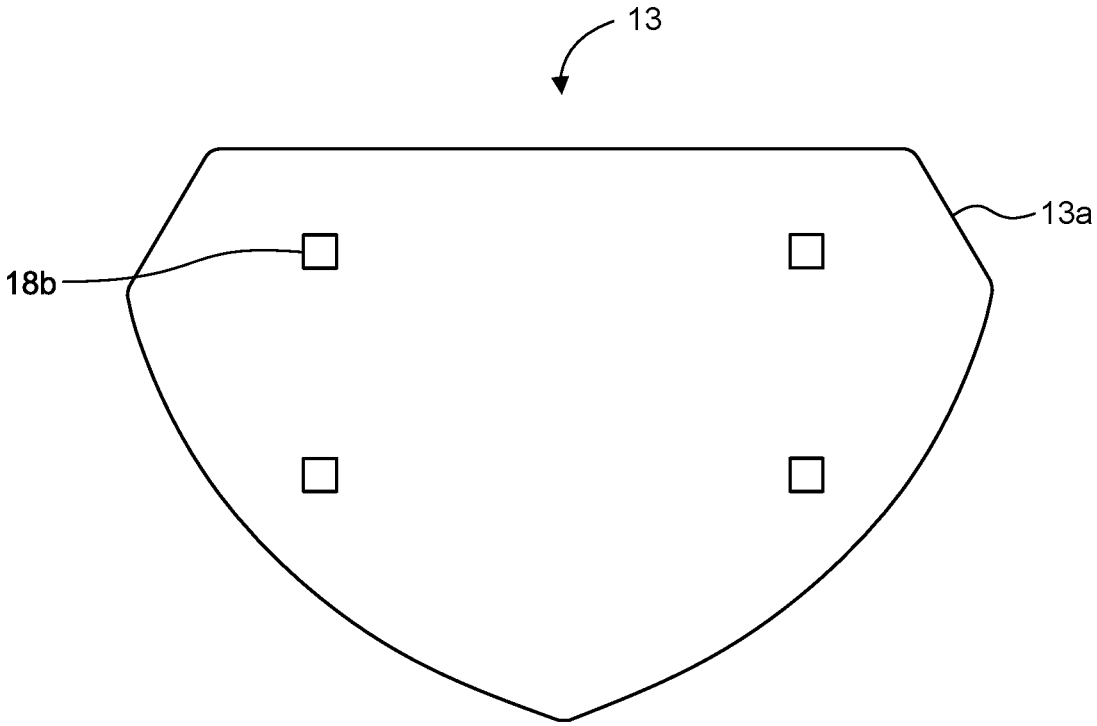
FIG. 4B is a view of the inside surface of the keepsake pouch of FIG. 3 without the divider.
Figure 5:
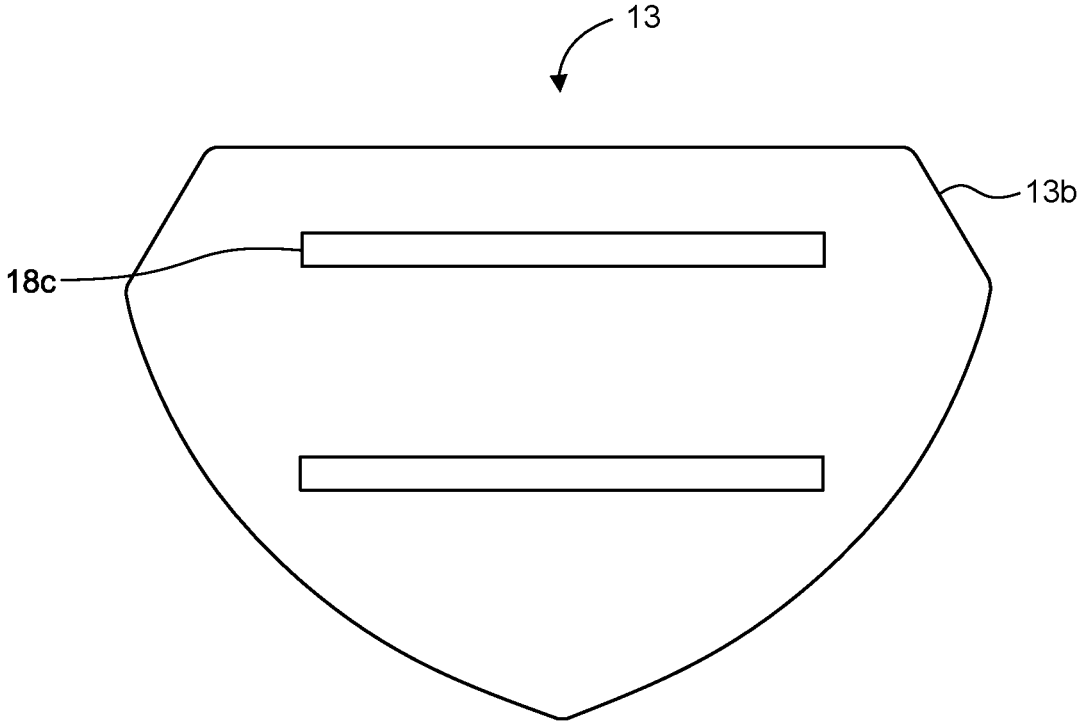
FIG. 5 is a view of a different inside surface of the keepsake pouch of FIG. 3, opposite the inside surface of the inside surface shown in FIGS. 4A and 4B.

The cremains and/or mementos of a loved one can be placed inside the keepsake pouch 13 for protecting and storing. The volume of cremains will be different based on the size of the deceased loved one. For example, humans and animals with a larger bone structure will have a larger amount of cremains than humans and animals with a smaller bone structure. To prevent movement of a smaller amount of cremains or small mementos within the keepsake pouch 13, a divider can be used to designate a smaller space to secure the remains. FIG. 4A is a view of an inside surface of the keepsake pouch 13 of FIG. 3 with a divider 17. The divider 17 can be affixed on an inside surface of the material piece 13*a* of the keepsake pouch 13. The inside surface without the divider is shown in FIG. 4B and faces an inside surface of the other material piece 13*b*, as shown in FIG. 5. The divider 17 can be made from a suitable fabric or material. At a minimum, the divider 17 should be constructed from a fabric or material that is bendable and sturdy. A shape of the divider can be determined based on a shape of the keepsake pouch 13 and fabric urn 10. The divider shapes can include square, rectangle, circle, or oval. Other shapes are possible.

At least a portion of the divider 17 can be affixed to the inner surface of the material piece 13*a* by sewing, gluing, or otherwise adhering the divider to an inside surface of the material piece 13*a*. In one embodiment, only a center of the divider is affixed to the material piece 13*a* by sewing or gluing a line down a center of the divider, leaving the sides of the divider 17 adjacent to the adhered portion, to move away from the inside surface of the material piece 13*a* toward the inside surface of the other material piece 13*b*, as shown in FIG. 5.

Fasteners will be described here in detail as 18*a*, 18*b*, and 18*c*. Fasteners 18*a* can be affixed to a surface of the divider that faces the inner surface of the material piece 13*a*, as shown in FIG. 4B. The fasteners 18*a* can include hook and loop fasteners, buttons, or snaps; however, other types of fasteners are possible. In one example, four sections of the hook fastener 18*a* can be affixed to the four corners of the rectangular divider 17 and span a distance about half of the divider as shown in FIG. 4A. However, in another embodiment, a different number of fasteners can be used.

When not in use, the divider is attached to the inside surface of the keepsake pouch 13 via further fasteners. FIG. 4B is a view of the same surface of the keepsake pouch 13 of FIG. 3 without the divider 17. The loop side of fasteners 18*b* can be affixed to an inside surface of the material piece 13*a* of the keepsake pouch 13 to hold the divider (not shown) against the material piece 13*a* when not in use. In one embodiment, four fasteners 18*b* can be used. Two of the fasteners can align with the outer corners of the upper fasteners on the divider 17, while the two remaining fasteners can align with the lower fasteners.

When used to create a smaller space within the keepsake pouch 13 for holding remains, including cremains and/or mementos, the hook side of the fasteners 18*a* on the divider 17 can be affixed to an inner surface of the opposite material piece 13*b*. The smaller space is created by connecting ends of the divider 17 on one material piece of the keepsake pouch 13 with the other piece of material. FIG. 5 is a view of a different inside surface 13*b* of the keepsake pouch 13 of FIG. 3. In one embodiment, two fasteners 18*c* can be affixed to an inside surface of a piece of material 13*b* opposite the material piece 13*a* of FIGS. 4A and B. For example, one loop fastener 18*c* on the other material piece 13*b* can be placed at the same distance from the bottom of the keepsake pouch 13 as the upper fasteners 18*a* on the divider 17 of the piece of material 13*a*, which is described above with respect to FIG. 4A, and the other loop fastener 18*c* can be placed at the same distance from the bottom of the keepsake pouch 13 as the lower fasteners 18*a*. The two loop fasteners 18*c* can each span a length of the divider; however, other sizes and numbers of the loop fasteners 18*c* are possible.

Figure 6:
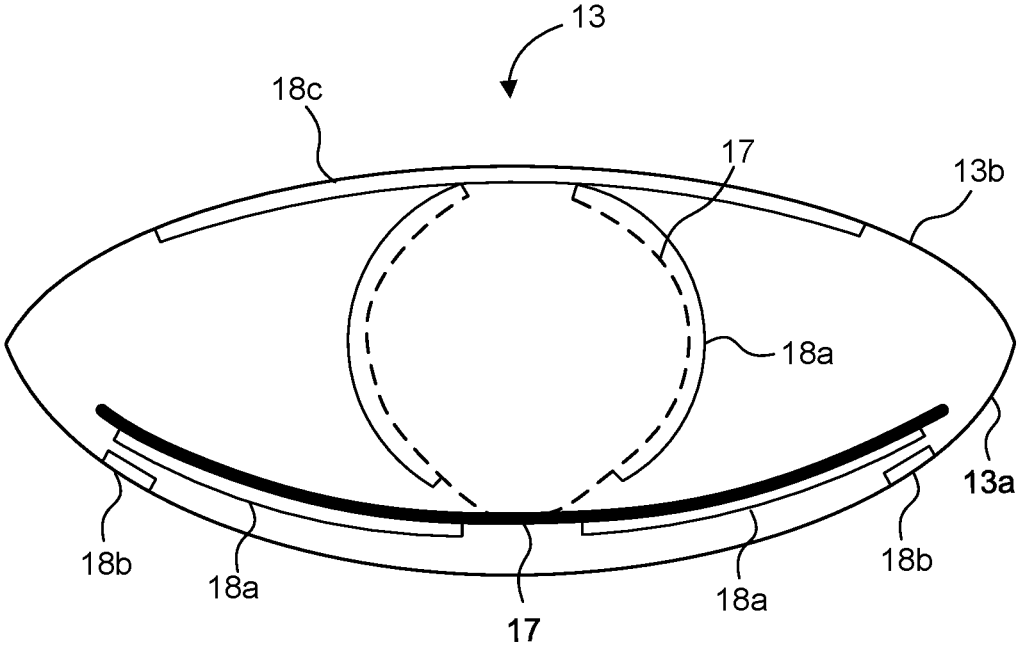
FIG. 6 is a top view of the divider for the keepsake pouch of FIG. 3 in a division position showing the divider depicted in FIG. 4A attached to the opposite inside surface depicted in FIG. 5.

The fasteners 18*a* on the divider 17 connect with the fasteners 18*c* on the other piece of material 13*b* to create a smaller space within the keepsake pouch 13 to hold smaller items, such as cremains, small photographs, clips of hair, baby or puppy teeth, timepieces, rings, and other types of small mementos. FIG. 6 is a top view of the divider 17 for the keepsake pouch 13 of FIG. 3 in use. In a rest position, the divider 17 lays against the inner surface of the material piece 13*a* of the keepsake pouch 13. However, when a smaller space is needed to secure cremains and/or mementos placed within the keepsake pouch 13, the outer ends of the divider 17 are moved away from the material piece 13*a* towards the inner surface of the other material piece 13*b*. The fasteners 18*a* on the corners of the inside surface of the divider 17 are connected with the upper and lower fasteners 18*c* on the other material piece 13*b*. Once connected, a smaller space is created within the keepsake pouch 13 for safe placements of smaller items.

Figure 7:
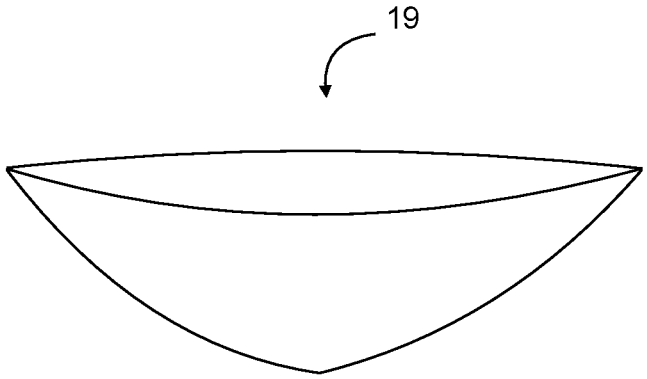
FIG. 7 is a side view showing, by way of example, the support member 19 for the keepsake pouch 13.

To further prevent contents of the keepsake pouch 13 from moving around, a support member 19 such as a "pillow like" cushion made of fabric or other material filled with cushioning material, can be used to support the contents of the keepsake pouch 13 and distribute the weight of the keepsake pouch 13 for a desirable balance and feel. FIG. 7 is a side view showing, by way of example, a support member 19 for the keepsake pouch 13. The cushioning material can be fabrics or materials such as foam, synthetic fiber fill, cotton, wool, or polypropylene weighted beads. The support member 19 can be placed inside the keepsake pouch 13 at the bottom and affixed as necessary to prevent slipping out of place. The use of polypropylene weighted beads as cushioning material can be used to serve to prevent slippage due to its weighted nature and allow the keepsake pouch 13 to stand up on its own vertically or lay relatively flat on its side for functional and aesthetic purposes.

Specifically, the keepsake pouch 13 can include an outer cover, which surrounds an outer surface of the two material pieces 13*a* and 13*b*. The support member 19 can be placed at the bottom of the inside outer cover over which the two material pieces 13*a* and 13*b* are positioned. In one embodiment, the outer cover of the support member 19 can be made from fabric, such as cotton silk, linen, wool, hemp, velvet, rayon, and polyester, as well as other material, such as fleece, leather, and suede. However, other materials are possible. The shape of the support member 19 can be dependent on the shape of the keepsake pouch 13 and fabric urn 10 to fit nicely into position. The size of the support member 19 can vary in length and width; however, the support member 19 should be small enough to fit below the divider 17 to allow the divider to freely move without interference when needed. In one embodiment, the support member 19 is comprised of three pieces of fabric or other material stitched together creating a finished 3-D shape similar to a canoe.

Figure 8:
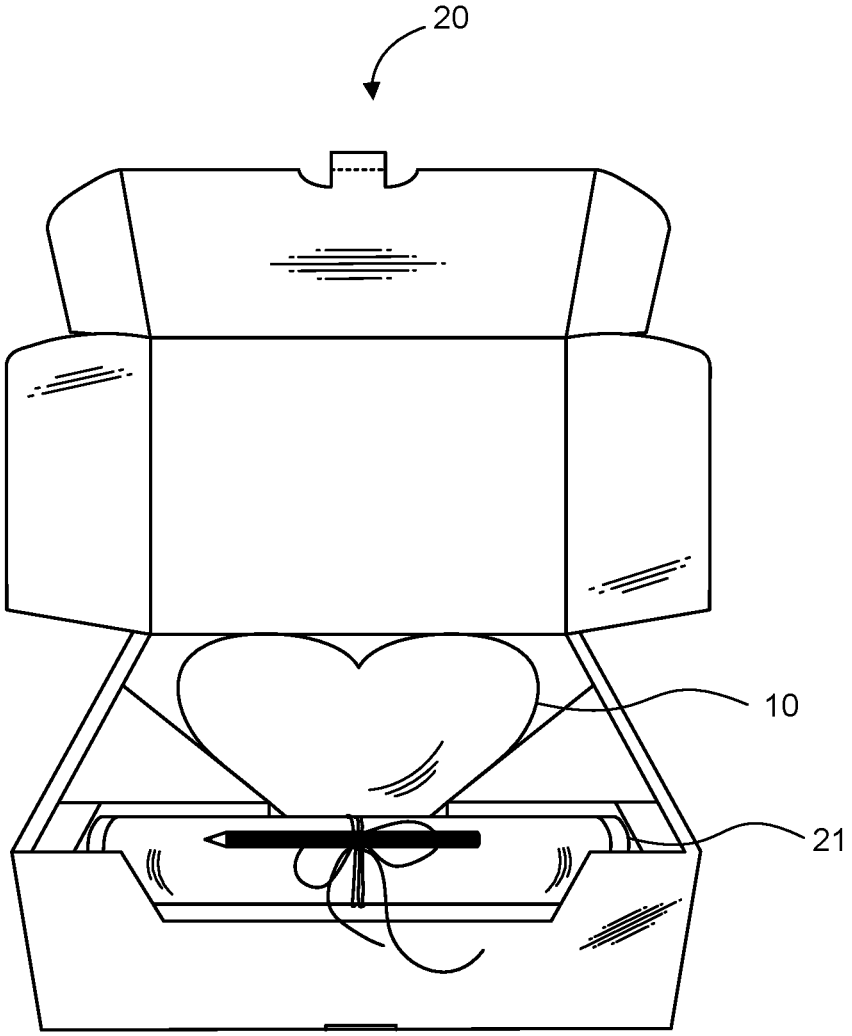
FIG. 8 is a view of the fabric urn of FIG. 1 in a memory box.

The fabric urn 10 can be provided as not only a practical and secure solution for the safe keeping of the loved one's remains in itself, including cremains and mementos, but also part of a healing or comfort package. FIG. 8 is a view of the fabric urn 10 of FIG. 1 in a memory box 20. The memory box 20 can include text, drawings, and designs such as pictures of their beloved, the sky, the sun, raindrops, clouds, a rainbow, the beach, or the mountains which can be healing and soothing to view. Inside the memory box 20, a cutout for the fabric urn 10 can be constructed, as well as a cutout for a memory scroll 21. The memory scroll 21 can include a large piece of cover paper and one or more pieces of writing or sketching paper underneath and wrapped around a hollow tube for storing the memory scroll 21. The paper can be secured around the tube via a tie. A writing instrument such as a pen or pencil can also be included. Using the paper and writing instrument, an individual can write or draw about their memories, thoughts and feelings, or record stories for example regarding their beloved or about the mementos stored in the keepsake pouch 13. After writing or drawing, the paper which has recorded the memories, thoughts and feelings, and/or stories can be rolled up and easily placed inside the tube for safe keeping and reference. When the individual wishes to start a new writing or drawing, he or she can begin a fresh sheet of paper that is stored as sheets rolled around the outside of the tube and under the cover paper.

In a further embodiment, the fabric urn can serve as another type of remembrance holder, a "memory keeper" to store, for example, nostalgic items, such as a hospital bracelet for a beloved new baby and can include a baby blanket and a baby picture. When the baby becomes an adult, the memory keeper can be provided to the baby as a remembrance of his or her birth.

In yet another embodiment, the fabric urn can be a remembrance holder for the special relationship that an individual has with his or her beloved pet, as most often, pets do not live as long as their humans, and yet loving bonds continue on. From puppyhood through the elder earthly years, the beloved pet can be connected with their "memory keeper" and memories and mementos can be stored by the individual, until one day, the individual may use this for the safe keeping of their beloved's ashes, if they choose. Other uses are also possible and envisioned.

While the invention has been particularly shown and described as referenced to the embodiments thereof, those skilled in the art will understand that the foregoing and other changes in form and detail may be made therein without departing from the spirit and scope of the invention.

The invention claimed is:

1. A fabric urn to hold cremains, comprising:

a cover comprising two pieces of material affixed to one another with an opening to an interior of the cover;

at least one support layer removably placed within the interior of the cover;

a keepsake pouch comprising at least two pieces of material affixed to one another with an opening to an interior of the pouch; and a divider affixed to an interior surface of the keepsake pouch and configured to hold the cremains.

2. The fabric urn according to claim 1 wherein two of the support layers are placed within the cover and the keepsake pouch is placed between the two support layers within the cover.

3. The fabric urn according to claim 1, further comprising:

a display frame affixed on one of the pieces of material of the keepsake pouch and configured to form a pocket between the piece of material of the keepsake pouch and the display frame.

4. The fabric urn according to claim 3, wherein the display frame comprises a piece of transparent material.

5. The fabric urn according to claim 1, further comprising:

one or more fasteners affixed to a surface of the divider that faces the interior surface of the keepsake pouch on which the divider is affixed.

6. The fabric urn according to claim 5, wherein both ends of the divider are removably affixed to the opposite interior surface of the keepsake pouch via the fasteners to create an enclosure within the keepsake pouch.

7. The fabric urn according to claim 1, wherein the divider is affixed to the interior surface of the keepsake pouch along a vertical center line of the divider.

8. The fabric urn according to claim 1, further comprising:

a weighted support member comprising at least three sides and shaped to removably fit in the keepsake pouch under the divider.

9. A fabric urn to hold cremains, comprising:

a cover comprising two pieces of material affixed to one another with an opening to an interior of the cover;

at least one support layer removably placed within the interior of the cover;

a keepsake pouch comprising at least two pieces of material affixed to one another with an opening on a top side of the pouch and sized to fit within the cover; and a divider affixed to an interior surface of the keepsake pouch and configured to hold the cremains.

10. The fabric urn according to claim 9, wherein the divider comprises a rectangular shape.

11. The fabric urn according to claim 10, wherein the divider is affixed to the interior surface of the keepsake pouch along a vertical center line of the divider.

12. The fabric urn according to claim 10, further comprising:

one or more fasteners affixed to a surface of the divider that faces the interior surface of the keepsake pouch on which the divider is affixed.

13. The fabric urn according to claim 12, wherein both ends of the divider are removably affixed to the opposite interior surface of the keepsake pouch via the fasteners to create an enclosure within the keepsake pouch.

14. The fabric urn according to claim 10, further comprising:

a weighted support member comprising at least three sides and shaped to removably fit in the keepsake pouch under the divider.

15. The fabric urn according to claim 9, further comprising:

a display frame affixed on one of the pieces of material of the keepsake pouch and configured to form a pocket between the piece of material of the keepsake pouch and the display frame.

16. The fabric urn according to claim 15, wherein the display frame comprises a piece of transparent material.

17. A system for holding cremains of a beloved, comprising:

a cover comprising two pieces of material affixed to one another with an opening to an interior of the cover;

at least one support layer removably placed within the interior of the cover;

a keepsake pouch comprising two pieces of material affixed to one another with an opening to an interior of the pouch and sized to fit within the cover;

a divider affixed within the keepsake pouch on an interior surface of one of the pieces of material of the keepsake pouch and configured to hold the cremains; and a weighted support member comprising at least three sides and shaped to removably fit in the keepsake pouch under the divider.

18. The system according to claim 17, further comprising:

one or more pieces of paper on which memories regarding the beloved can be recorded, and a writing instrument to use with the paper.

19. The system according to claim 18, further comprising:

a box shaped to hold the cover, the at least one support layer, the keepsake pouch, the one or more pieces of paper, and the writing instrument.

* * * * *